US009474109B2

(12) United States Patent
Tonomura et al.

(10) Patent No.: US 9,474,109 B2
(45) Date of Patent: Oct. 18, 2016

(54) INDUCTION HEATING APPARATUS

(75) Inventors: Toru Tonomura, Kyoto (JP); Yasuhiro Fujimoto, Kyoto (JP)

(73) Assignee: TOKUDEN CO., LTD., Kyoto-shi (JP)

( * ) Notice: Subject to any disclaimer, the term of this patent is extended or adjusted under 35 U.S.C. 154(b) by 929 days.

(21) Appl. No.: 13/584,570

(22) Filed: Aug. 13, 2012

(65) Prior Publication Data

US 2014/0042151 A1 Feb. 13, 2014

(51) Int. Cl.
*H05B 6/36* (2006.01)
*H05B 6/10* (2006.01)

(52) U.S. Cl.
CPC ..... *H05B 6/104* (2013.01); *H05B 6/365* (2013.01)

(58) Field of Classification Search
CPC ..... H05B 6/101; H05B 6/104; H05B 6/365; H05B 6/40
USPC ..... 219/645, 646, 653, 672, 673, 674, 675, 219/676, 635, 636, 637
See application file for complete search history.

(56) References Cited

U.S. PATENT DOCUMENTS

| | | | | |
|---|---|---|---|---|
| 3,444,346 | A * | 5/1969 | Russell et al. | H05B 6/104 219/645 |
| 5,401,941 | A | 3/1995 | Mauve et al. | |
| 2011/0248025 | A1 * | 10/2011 | Dallazanna | H05B 6/101 219/647 |

FOREIGN PATENT DOCUMENTS

| | | | | |
|---|---|---|---|---|
| CN | 1208542 | A | | 2/1999 |
| CN | 2596707 | Y | | 12/2003 |
| CN | 202738152 | U | | 2/2013 |
| JP | 560025179 | A | | 2/1985 |
| JP | 2-117087 | A | * | 5/1990 |
| JP | H02155193 | A | | 6/1990 |
| JP | 04147596 | | | 5/1992 |
| JP | H09103804 | A | | 4/1997 |
| JP | 2002194430 | A | | 7/2002 |

OTHER PUBLICATIONS

State Intellectual Property Office of the People's Republic of China, Office Action Issued in Chinese Patent Application No. 201210289026.3, Sep. 28, 2015, 8 pages.
Japanese Patent Office, Office Action Issued in Japanese Patent Application No. 2012-029787, Dec. 8, 2015, 2 pages.

* cited by examiner

*Primary Examiner* — Hung D Nguyen
(74) *Attorney, Agent, or Firm* — Alleman Hall McCoy Russell & Tuttle LLP

(57) ABSTRACT

An induction heating apparatus capable of heating a conductive plate member throughout in a widthwise direction is disclosed. Specifically, the present invention is configured to have flat-shaped coils, each forming a magnetic path in a center portion thereof, provided on upper and lower sides of the conductive plate member so as to heat the conductive plate member and to have circumferential coils provided on right and left end sides of magnetic metal casings through which the circumferential magnetic paths of the flat-shaped coils pass, whereby magnetic paths of the circumferential coils pass through both end portions of the conductive plate member.

4 Claims, 16 Drawing Sheets

INDUCTION HEATING APPARATUS

TECHNICAL FIELD

The present invention relates to an induction heating apparatus for induction-heating, for example, a metal belt, metal sheet and the like.

BACKGROUND ART

Conventionally, induction heating of a metal belt or metal sheet and such has been executed by an induction heating apparatus of a solenoid coil equipment type or a transverse coil equipment type.

However, in the case of induction-heating of a metal sheet with an intermediate-frequency power supply of 50 Hz to 1000 Hz by this induction heating apparatus, it is necessary to configure a magnetic circuit having a relatively small magnetic resistance. This is because the larger the magnetic resistance is, the lower a power factor becomes so that heating efficiency becomes worse.

In addition, in the induction heating of a metal sheet by the conventional induction heating apparatus, there is a problem that temperatures at both ends in a direction (width direction) orthogonal to a conveying direction of the metal sheet are suppressed from rising so as to remain low. In particular, in an induction heating apparatus of a hydraulic pressurizing type for feeding out an object to be heated while the object to be heated is pressurized with hydraulic pressure, it is difficult to circulate a magnetic flux generated outside a seal structure part of the hydraulic pressure by a coil, and this results in a problem that the temperature of the metal sheet positioned outside the seal structure part is lowered so as to be defective. Note that an object to be heated is referred to as a "heating target object," hereinafter.

CITATION LIST

Patent Literature

Patent Document 1: JP Heisei 04-147596A

SUMMARY OF INVENTION

Technical Problem

Therefore, the present invention has been made to solve the problems mentioned above, and an essential object thereof is to provide an induction heating apparatus capable of uniformly heating throughout a conductive plate member such as a metal sheet.

Solution to Problem

That is, an induction heating apparatus according to a first aspect of the present invention is adapted to induction heating of a conductive plate member with an intermediate-frequency wave of 50 Hz to 1000 Hz, and the induction heating apparatus includes: a conveyance passage in which the conductive plate member is conveyed; a first flat-shaped coil arranged on an upper side of the conveyance passage and provided with a magnetic path orthogonal to the conveyance passage in a center portion thereof; a second flat-shaped coil arranged on a lower side of the conveyance passage and provided with a magnetic path orthogonal to the conveyance passage in a center portion thereof; a first circumferential magnetic path member arranged around the first flat-shaped coil and forming a circumferential magnetic path for guiding a magnetic flux generated by the first flat-shaped coil to the lateral outside of the conveyance passage; and a second circumferential magnetic path member arranged around the second flat-shaped coil and forming a circumferential magnetic path for guiding a magnetic flux generated by the second flat-shaped coil to the lateral outside of the conveyance passage and connected to the first circumferential magnetic path member. In this configuration, the magnetic fluxes generated by the first and second flat-shaped coils are configured to pass through both right and left end portions of the conductive plate member conveyed to the conveyance passage by the first and second circumferential magnetic path members. Herein, both of the right and left end portions of the conductive plate member are both end portions of the conductive plate member in a widthwise direction.

With this configuration, the magnetic fluxes generated by the first and second flat-shaped coils are circulated from the center magnetic path of the coils through the circumferential magnetic paths so that induction current is induced in the conductive plate member positioned between the first and second flat-shaped coils. In specific, since the first and second circumferential magnetic path members extend the circumferential paths to the right and left outsides of the conveyance passage while the first and second circumferential magnetic path members are connected to each other, not only can the right and left end portions of the conductive plate member as well as the center portion thereof be heated, but also magnetic resistance of each of the circumferential magnetic paths can be reduced. In addition, by adjusting the sizes of the first and second circumferential magnetic path members, the size in the lateral direction of the conveyance passage can be appropriately set.

Moreover, an induction heating apparatus according to a second aspect of the present invention is adapted to induction heating of a conductive plate member with an intermediate-frequency wave of 50 Hz to 1000 Hz, and the induction heating apparatus includes: a first flat-shaped coil arranged on an upper side of the conductive plate member and provided with a magnetic path orthogonal to the conductive plate member in a center portion thereof; a second flat-shaped coil arranged on a lower side of the conductive plate member and provided with a magnetic path orthogonal to the conductive plate member in a center portion thereof; a first circumferential magnetic path member arranged around the first flat-shaped coil and forming a circumferential magnetic path through which a magnetic flux generated by the first flat-shaped coil passes; a second circumferential magnetic path member arranged around the second flat-shaped coil and forming a circumferential magnetic path through which a magnetic flux generated by the second flat-shaped coil passes; a first circumferential coil wounded concentrically with the first flat-shaped coil around the first circumferential magnetic path member or around a magnetic metal casing disposed around the first circumferential magnetic path member; and a second circumferential coil wounded concentrically with the second flat-shaped coil around the second circumferential magnetic path member or around a magnetic metal casing disposed around the second circumferential magnetic path member. In this configuration, the magnetic fluxes generated by the first and second circumferential coils are configured to pass through both right and left end portions of the conductive plate member.

With this configuration, the central portion of the conductive plate member can be heated by the first and second flat-shaped coils. Moreover, since the first and second circumferential coils are provided around the first and second circumferential magnetic path members or magnetic metal casings, both of the right and left end portions of the conductive plate member can be heated by the magnetic fluxes generated by the first and second circumferential coils. Further, by adjusting electrification amounts of the first and second flat-shaped coils and electrification amounts of the first and second circumferential coils, a temperature distribution in the widthwise direction of the conductive plate member can be controlled.

Further, an induction heating apparatus according to a third aspect of the present invention is adapted to induction heating of a conductive plate member with an intermediate-frequency wave of 50 Hz to 1000 Hz, and the induction heating apparatus includes: a first flat-shaped coil arranged on an upper side of the conductive plate member and provided with a magnetic path orthogonal to the conductive plate member in a center portion thereof; a second flat-shaped coil arranged on a lower side of the conductive plate member and provided with a magnetic path orthogonal to the conductive plate member in a center portion thereof; a first circumferential magnetic path member arranged around the first flat-shaped coil and forming a circumferential magnetic path through which a magnetic flux generated by the first flat-shaped coil passes; a second circumferential magnetic path member arranged around the second flat-shaped coil and forming a circumferential magnetic path through which a magnetic flux generated by the second flat-shaped coil passes; iron-core members provided in contact with respective right and left outside surfaces of the conductive plate member in the first circumferential magnetic path member or a magnetic metal casing disposed around the first circumferential magnetic path member and in the second circumferential magnetic path member or a magnetic metal casing disposed around the second circumferential magnetic path member; and circumferential coils wounded around the iron-core members. In this configuration, magnetic fluxes generated by the circumferential coils are configured to pass through both right and left end portions of the conductive plate member by the iron-core members.

With this configuration, the central portion of the conductive plate member can be heated by the first and second flat-shape coils. Moreover, since the iron-core members are provided in contact with the first and second circumferential magnetic path members or magnetic metal casings and the circumferential coils are wound around the iron-core members, the magnetic fluxes generated by the circumferential coils can be passed through the first and second circumferential magnetic path members or magnetic metal casings and the right and left end portions of the conductive plate member so that both the right and left end portions of the conductive plate member can be heated. Further, by adjusting electrification amounts of the first and second flat-shaped coils and electrification amounts of the circumferential coils, a temperature distribution in the widthwise direction of the conductive plate member can be controlled.

In the induction heating apparatus mentioned above, in order to render the lateral temperature distribution of the conductive plate member still further uniform, the first flat-shaped coil and second flat-shaped coil are desirably divided into a plurality of flat-shaped division coils which are arranged so as to be laterally shifted. In particular, the first flat-shaped coil and second flat-shaped coil are desirably divided into two flat-shaped division coils having the same configuration and the same shape, which are arranged so that a center axis of one of the two flat-shaped division coils is set to a position where a winding diameter of a wound coil of the other flat-shaped division coil is divided into two.

Further, an induction heating apparatus according to a fourth aspect of the present invention is adapted to induction heating of a conductive plate member with an intermediate-frequency wave of 50 Hz to 1000 Hz, and the induction heating apparatus includes: a first flat-shaped coil arranged on an upper side of the conductive plate member and provided with a magnetic path orthogonal to the conductive plate member in a center portion thereof; a second flat-shaped coil arranged on a lower side of the conductive plate member and provided with a magnetic path orthogonal to the conductive plate member in a center portion thereof; a first circumferential magnetic path member arranged around the first flat-shaped coil and forming a circumferential magnetic path for guiding a magnetic flux generated by the first flat-shaped coil to the outside of the conductive plate member; and a second circumferential magnetic path member arranged around the second flat-shaped coil and forming a circumferential magnetic path for guiding a magnetic flux generated by the second flat-shaped coil to the outside of the conductive plate member and connected to the first circumferential magnetic path member. In this configuration, the magnetic fluxes generated by the first and second flat-shaped coils are configured to pass through end portions of the conductive plate member by the first and second circumferential magnetic path members.

Further, an induction heating apparatus according to a fifth aspect of the present invention is adapted to induction heating of a conductive plate member with an intermediate-frequency wave of 50 Hz to 1000 Hz, and the induction heating apparatus includes: a first flat-shaped coil arranged on an upper side of the conductive plate member and provided with a magnetic path orthogonal to the conductive plate member in a center portion thereof; a second flat-shaped coil arranged on a lower side of the conductive plate member and provided with a magnetic path orthogonal to the conductive plate member in a center portion thereof; a first circumferential magnetic path member arranged around the first flat-shaped coil and forming a circumferential magnetic path through which a magnetic flux generated by the first flat-shaped coil passes; a second circumferential magnetic path member arranged around the second flat-shaped coil and forming a circumferential magnetic path through which a magnetic flux generated by the second flat-shaped coil passes; an iron-core member provided in contact with respective outside surfaces of the conductive plate member in the first circumferential magnetic path member or a magnetic metal casing disposed around the first circumferential magnetic path member and in the second circumferential magnetic path member or a magnetic metal casing disposed around the second circumferential magnetic path member; and a circumferential coil wounded around the iron-core member. In this configuration, a magnetic flux generated by the circumferential coil passes through end portions of the conductive plate member by the iron-core member.

In order to insulate the first and second flat-shaped coils from the heated conductive plate member so as to hold the conductive plate member by taking advantage of the corresponding insulating structure, it is desirable that the induction heating apparatus includes: a first heat insulating member provided between the first flat-shaped coil and the conductive plate member so as to insulate heat from the conductive plate member; and a second heat insulating member provided between the second flat-shaped coil and the conductive plate member so as to insulate heat from the conductive plate member. In this configuration, the first and second heat insulating members are configured to hold the conductive plate member from upper and lower sides thereof. With this configuration, there is no need for providing a holding mechanism for holding an additional conductive plate member other than the insulating member. Herein, in order to perform the insulation and holding without fail, it is desirable that the first and second heat insulating members are configured to hold the conductive plate member by covering the entire circumference thereof.

Advantageous Effects of Invention

According to the present invention configured as described above, lowering of the temperature at end portions in a surface direction of the conductive plate member such as a metal sheet can be suppressed so that the temperature in the surface direction of the conductive plate member can be made uniform.

DESCRIPTION OF EMBODIMENTS

The following describes embodiments of an induction heating apparatus according to the present invention with reference to the drawings.

First Embodiment

An induction heating apparatus 100 according to a first embodiment is adapted to continuously induction-heat a conductive plate member, such as a thin plate-shaped metal sheet, at an intermediate frequency of 50 Hz to 1000 Hz. For example, a plate-shaped or sheet-shaped member made of metal such as aluminum is used as the conductive plate member. Incidentally, a conductive plate member such as an aluminum sheet is difficult to be induction-heated in a conventional intermediate frequency induction heating apparatus.

Figure 1:
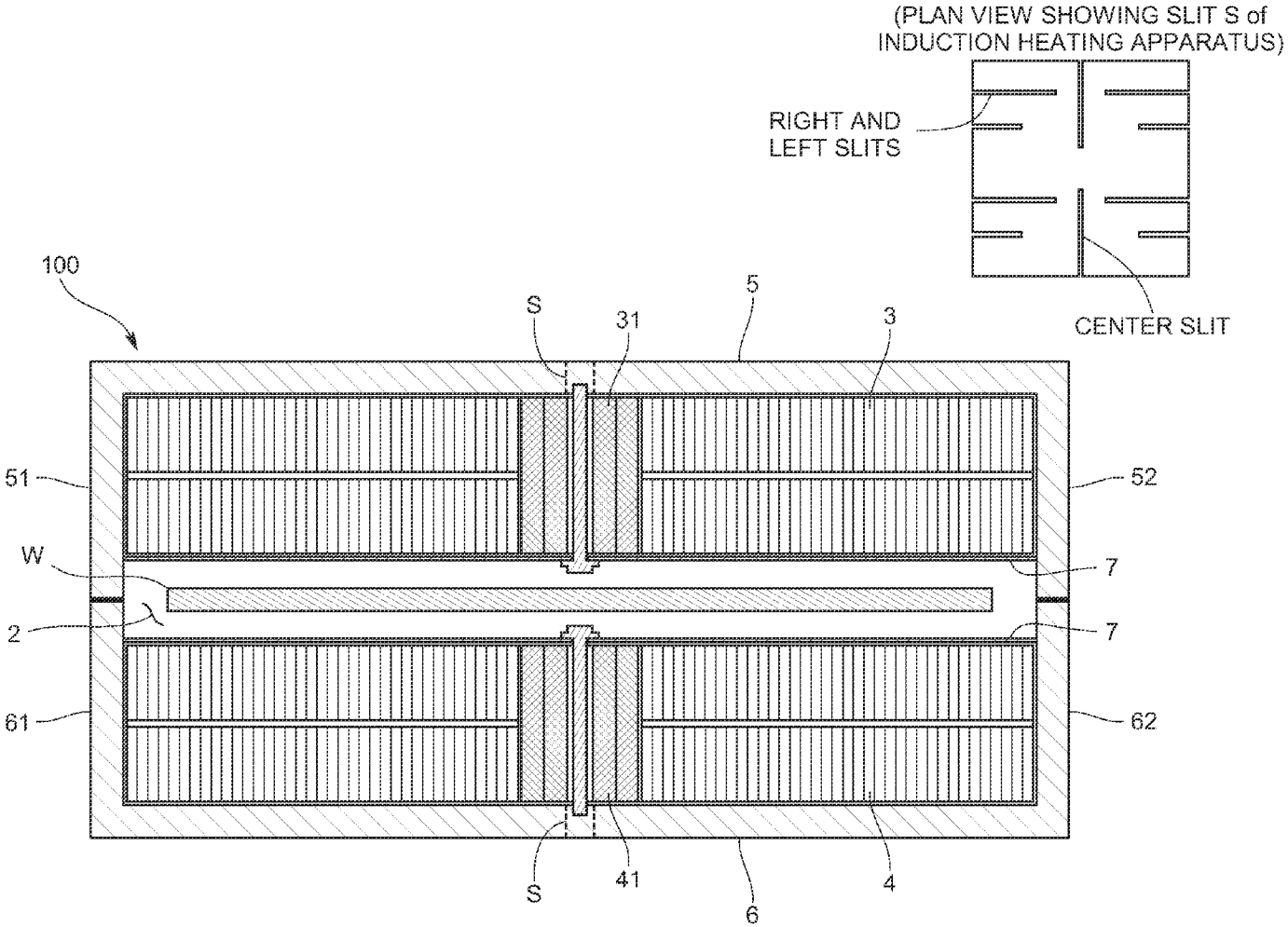
FIG. 1 is a sectional view showing a section orthogonal to a conveying direction of an induction heating apparatus according to a first embodiment.

Specifically, as shown in FIG. 1, this induction heating apparatus 100 includes: a conveyance passage 2 in which a metal sheet W is conveyed; a first flat-shaped coil 3 arranged on an upper side of the conveyance passage 2 and provided with a magnetic path orthogonal to the conveyance passage 2 in a center portion thereof; a second flat-shaped coil 4 arranged on a lower side of the conveyance passage 2 and provided with a magnetic path orthogonal to the conveyance passage 2 in a center portion thereof; a first circumferential magnetic path member 5 arranged around the first flat-shaped coil 3 and forming a circumferential magnetic path for guiding a magnetic flux generated by the first flat-shaped coil 3 to the lateral outside of the conveyance passage 2; and a second circumferential magnetic path member 6 arranged around the second flat-shaped coil 4 and forming a circumferential magnetic path for guiding a magnetic flux generated by the second flat-shaped coil 4 to the lateral outside of the conveyance passage 2.

The first and second flat-shaped coils 3 and 4 have the same configuration and the same shape as each other and have schematically rectangular shapes in plan view. In the center portions of these flat-shaped coils 3 and 4, provided are center iron-cores 31 and 41 for forming center magnetic paths of the coils. Herein, sizes of the flat-shaped coils 3 and 4 in the widthwise direction thereof orthogonal to the conveyance direction thereof are substantially the same size or larger than the conveyance passage 2 in the widthwise direction thereof. With this configuration, it is configured that the sizes of the flat-shaped coils 3 and 4 in the widthwise direction thereof are made larger than the size in the widthwise direction of the metal sheet W to be conveyed into the conveyance passage 2. Further, a pair of insulating plates 7 is provided between the first and second flat-shaped coils 3 and 4 and the conveyance passage 2 so as to prevent a short circuit from occurring between the first and second flat-shaped coils 3 and 4 and the metal sheet W. Note that the upper and lower surfaces (i.e., upper and lower boundaries) of the conveyance passage 2 are formed by the paired insulating plates 7.

The first and second circumferential magnetic path members 5 and 6 are arranged around the first and second flat-shaped coils 3 and 4, respectively. Specifically, the first circumferential magnetic path member 5 is a coil storage casing made of a magnetic metal material that covers the upper surface of the first flat-shaped coil 3, front and rear side surfaces (i.e. side surfaces opposing in the direction along the conveying direction) thereof and lateral side surfaces (i.e. side surfaces opposing in the direction orthogonal to the conveying direction) thereof to thereby accommodate the first flat-shaped coil 3 and that are formed to have a substantially hollow rectangular parallelepiped shape with its lower side opening. Also, the second circumferential magnetic path member 6 is a coil storage casing made of a magnetic metal material that covers the lower surface of the second flat-shaped coil 4, front and rear side surfaces thereof and lateral side surfaces thereof to thereby accommodate the second flat-shaped coil 4 and that is formed to have a substantially hollow rectangular parallelepiped shape with its upper side opening.

Moreover, in the present embodiment, in order to avoid heat generation in the first and second circumferential magnetic path members 5 and 6, a slit S for preventing a short-circuit current is formed in each of the first and second circumferential magnetic path members 5 and 6. Otherwise, in order to avoid the heat generation in the first and second circumferential magnetic path members 5 and 6, the first and second circumferential magnetic path members 5 and 6 may be configured by laminating thin layers of insulating magnetic material such as silicon steel. Otherwise, in the case of also heating the first and second circumferential magnetic path members 5 and 6 positively for use in auxiliary heating and the like, it may be considered to adopt a solid-core magnetic body or a magnetic body having a slit with its depth adjusted.

Further, right and left side walls 51 and 52 of the first circumferential magnetic path member 5 are positioned outside the conveyance passage 2, and in the present embodiment, the right and left side walls 51 and 52 form right and left side surfaces (i.e., right and left boundaries) of the conveyance passage 2. Similarly, right and left side walls 61 and 62 of the second circumferential magnetic path member 6 are positioned outside the conveyance passage 2, and the right and left side walls 61 and 62 form right and left side surfaces (i.e., right and left boundaries) of the metal plate conveyance passage 2. In this way, in the present embodiment, the right and left side walls 51 and 52 of the first circumferential magnetic path member 5 and the right and left side walls 61 and 62 of the second circumferential magnetic path member 6 define a widthwise size of the conveyance passage 2.

Thus, lower end portions of the right and left side walls 51 and 52 of the first circumferential magnetic path member 5 and upper end portions of the right and left side walls 61 and 62 of the second circumferential magnetic path member 6 are connected to each other. By connecting the first circumferential magnetic path member 5 and the second circumferential magnetic path member 6 in this way, magnetic resistance of the magnetic path where the magnetic fluxes generated by the first and second flat-shaped coils 3 and 4 pass is reduced so that the power factor is increased so as to improve heating efficiency.

In this induction heating apparatus 100, the magnetic fluxes generated by the flat-shaped coils 3 and 4 are circulated from coil center magnetic paths formed by the center iron-cores 31 and 41 installed in the center portions of the coils through the circumferential magnetic path formed by the circumferential magnetic path members 5 and 6. Thus, induction current is induced in the metal sheet W located between the first flat-shaped coil 3 and the second flat-shaped coil 4 so that the metal sheet W is heated. Moreover, since the right and left side walls 51 and 52 of the first circumferential magnetic path member 5 and the right and left side walls 61 and 62 of the second circumferential magnetic path member 6 are extended to the outside of the metal sheet W, the magnetic path formed by the first and second flat-shaped coils 3 and 4 passes through both of the right and left end portions of the metal sheet W that is conveyed in the conveyance passage 2 so that both of the right and left end portions of the metal sheet W can be surely heated.

Second Embodiment

The induction heating apparatus 100 according to a second embodiment is adapted to pressurize an insulating substance W which is a treating target object with a pair of upper and lower metal sheet belts B and induction-heat the metal sheet belts B at an intermediate frequency of 50 Hz to 1000 Hz to thereby heat the heating target object W. Note that, in FIG. 2, component members corresponding to those in the first embodiment are denoted by the same reference numerals.

Figure 2:
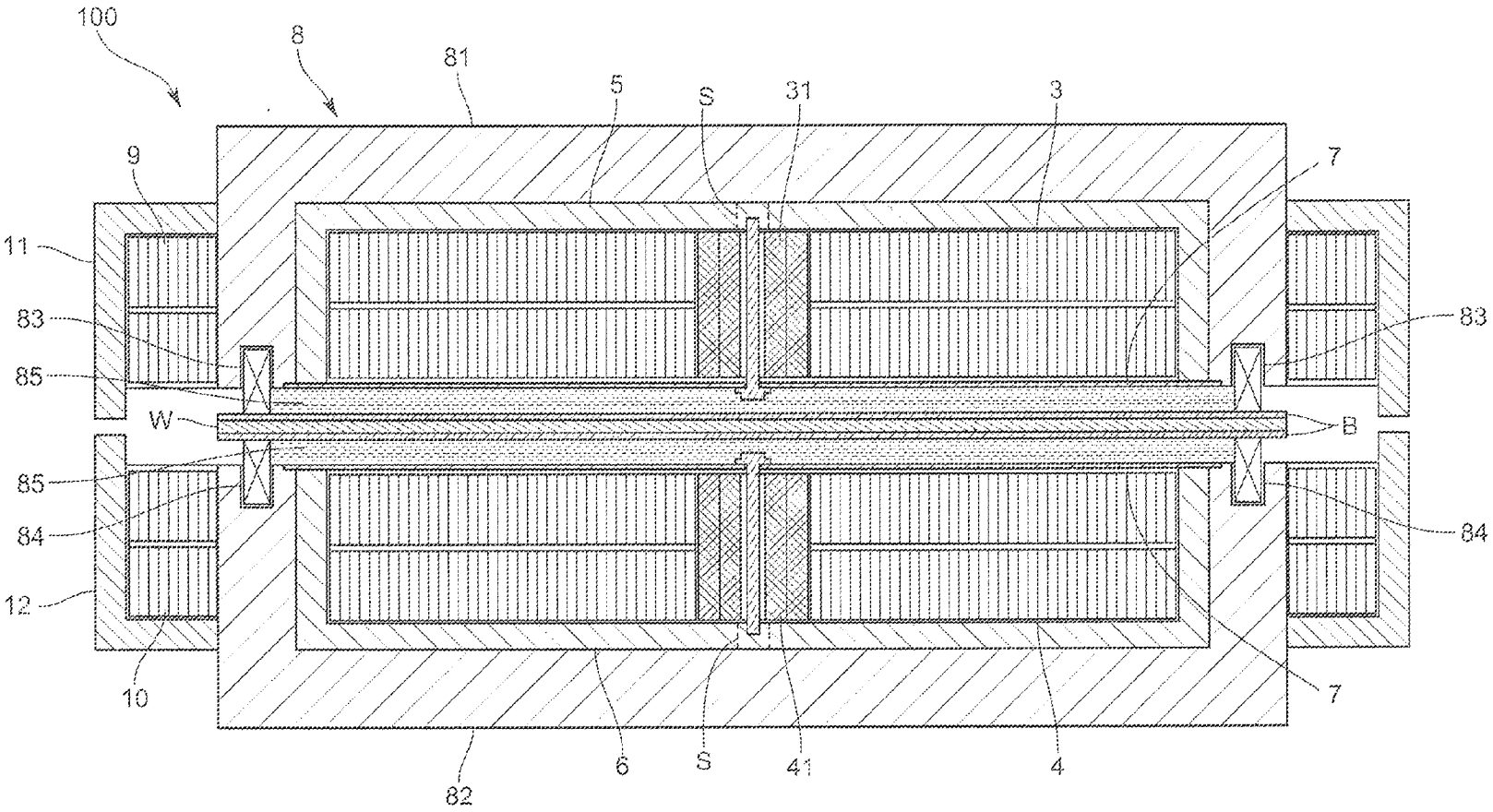
FIG. 2 is a sectional view showing a section orthogonal to a conveying direction of an induction heating apparatus according to a second embodiment.

Specifically, as shown in FIG. 2, this induction heating apparatus 100 includes: a pair of upper and lower metal sheet belts B (for example, metal shin layer of SUS400) forming a conveyance passage 2 in which a heating target object W is conveyed; a first flat-shaped coil 3 arranged on an upper side of the metal sheet belts B and provided with a magnetic path orthogonal to the metal sheet belts B in a center portion thereof; a second flat-shaped coil 4 arranged on a lower side of the metal sheet belts B and provided with a magnetic path orthogonal to the metal sheet belts B in a center portion thereof; a first coil storage casing 5 arranged around the first flat-shaped coil 3 and forming a circumferential magnetic path through which a magnetic flux generated by the first flat-shaped coil 3 passes; a second coil storage casing 6 arranged around the second flat-shaped coil 4 and forming a circumferential magnetic path through which a magnetic flux generated by the second flat-shaped coil 4 passes; and a pressurizing structure 8 for pressurizing the heating target object W by the pair of upper and lower metal sheet belts B.

Specifically, the pressurizing structure 8 includes: a first hydraulic casing 81 including a magnetic metal for accommodating the first coil storage casing 5; a second hydraulic casing 82 including a magnetic metal such as, e.g., SS400 for accommodating the second coil storage casing 6; hydraulic seals 83 and 84 including insulating members interposed between the first and second hydraulic casings 81 and 82 and the metal sheet belts B; and hydraulic oil 85 sealed in the first and second hydraulic casings 81 and 82. In a case where a hydraulic pressuring mechanism is added to the induction heating apparatus 100 in this way, it is configured that the hydraulic casings 81 and 82 and the hydraulic seals 83 and 84 are located outside the coil storage casings 5 and 6 because a high hydraulic pressure is applied so that the pressurizing structure 8 is structured to have the widthwise sizes of the coil storage casings 5 and 6 being smaller than that of the metal sheet belts B. For this reason, extended portions of the metal sheet belts B laterally and outwardly protruded from the hydraulic seals 83 and 84 are not heated, and therefore the temperature rising at both of the right and left end portions of the metal sheet belts B is significantly lowered.

Therefore, the induction heating apparatus 100 according to the second embodiment includes a first circumferential coil 9 wounded concentrically with the first flat-shaped coil 3 outside the first circumferential magnetic path member 5 and a second circumferential coil 10 wounded concentrically with the second flat-shaped coil 4 outside the second circumferential magnetic path member 6.

More specifically, the first circumferential coil 9 is provided around the first hydraulic casing 81 that is provided around the first circumferential magnetic path member 5, and the second circumferential coil 10 is provided around the second hydraulic casing 82 that is provided around the second circumferential magnetic path member 6. The first circumferential coil 9 is provided to be wound concentrically with the first flat-shaped coil 3 around the first hydraulic casing 81. Also, the second circumferential coil 10 is provided to be wound concentrically with the second flat-shaped coil 4 around the second hydraulic casing 82.

Moreover, a first cover member 11, which includes a magnetic metal covering an upper surface and side peripheral surface of the first circumferential coil 9, is provided around the first circumferential coil 9, and a second cover member 12, which includes a magnetic metal covering a lower surface and side peripheral surface of the second circumferential coil 10, is provided around the second circumferential coil 10. In addition, the first and second cover members 11 and 12 are provided on the first and second hydraulic casings 81 and 82, respectively. In addition, a slit S is formed in each of the first and second cover members 11 and 12 for preventing heat generation.

By providing these first and second cover members 11 and 12, there is formed a magnetic path through which magnetic fluxes generated by the first and second circumferential coils 9 and 10 pass through the right and left end portions of the metal sheet belts B via the side walls of the first and second hydraulic casings 81 and 82. Thus, the right and left end portions of the metal sheet belts B can be surely heated.

In addition, a free end portion of the first cover member 11 (i.e., a lower end portion of the side wall) and a free end portion of the second cover member 12 (i.e., an upper end portion of the side wall) may be connected to each other so as to reduce the magnetic resistance of the magnetic path through which the magnetic fluxes generated by the first and second circumferential coils 9 and 10 travel so that a power factor is increased so as to improve heating efficiency.

Figure 3:
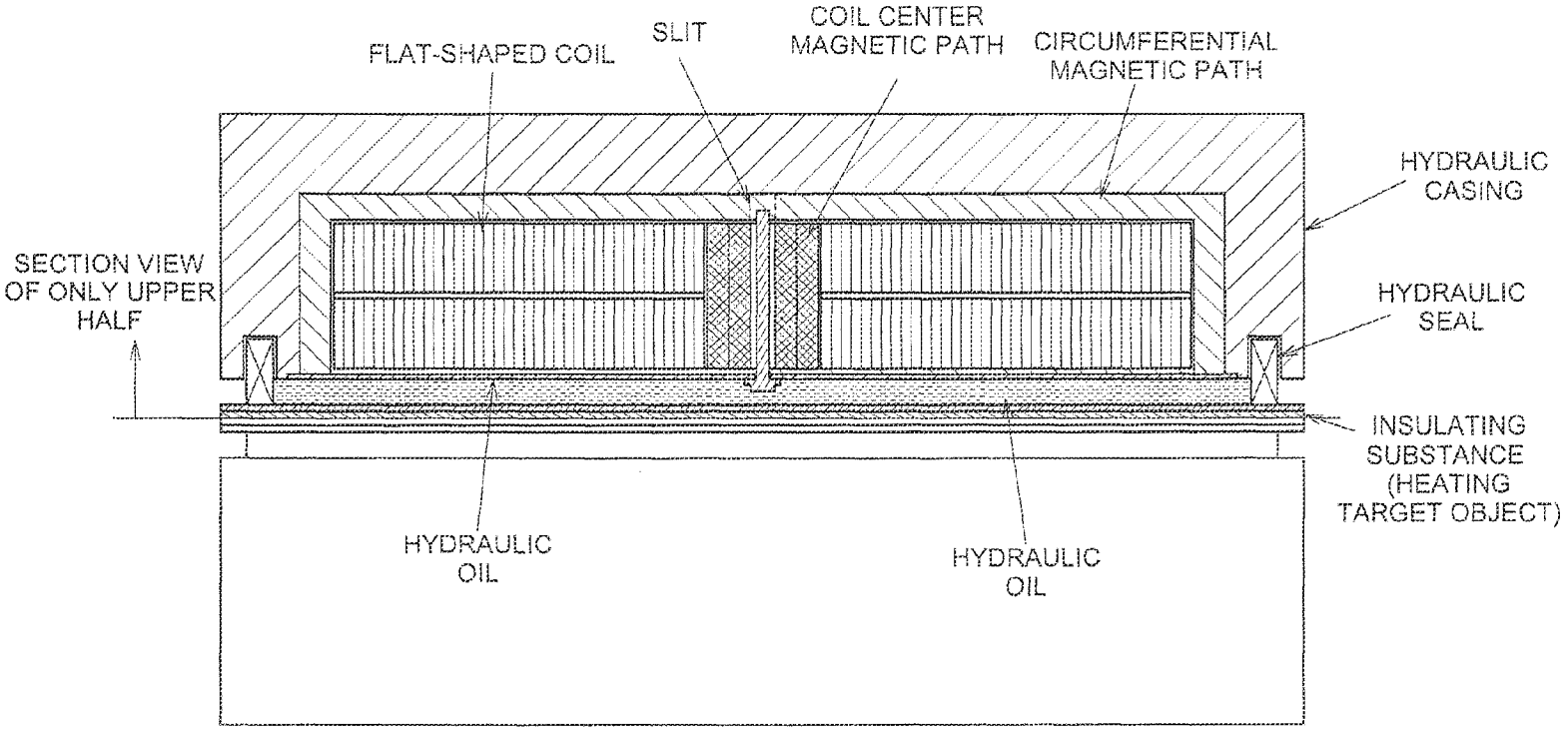
FIG.3 (PRIOR ART)
FIG. 3 is a front view showing a partial section of an induction heating apparatus of a conventional hydraulic pressurizing type.
Figure 4:
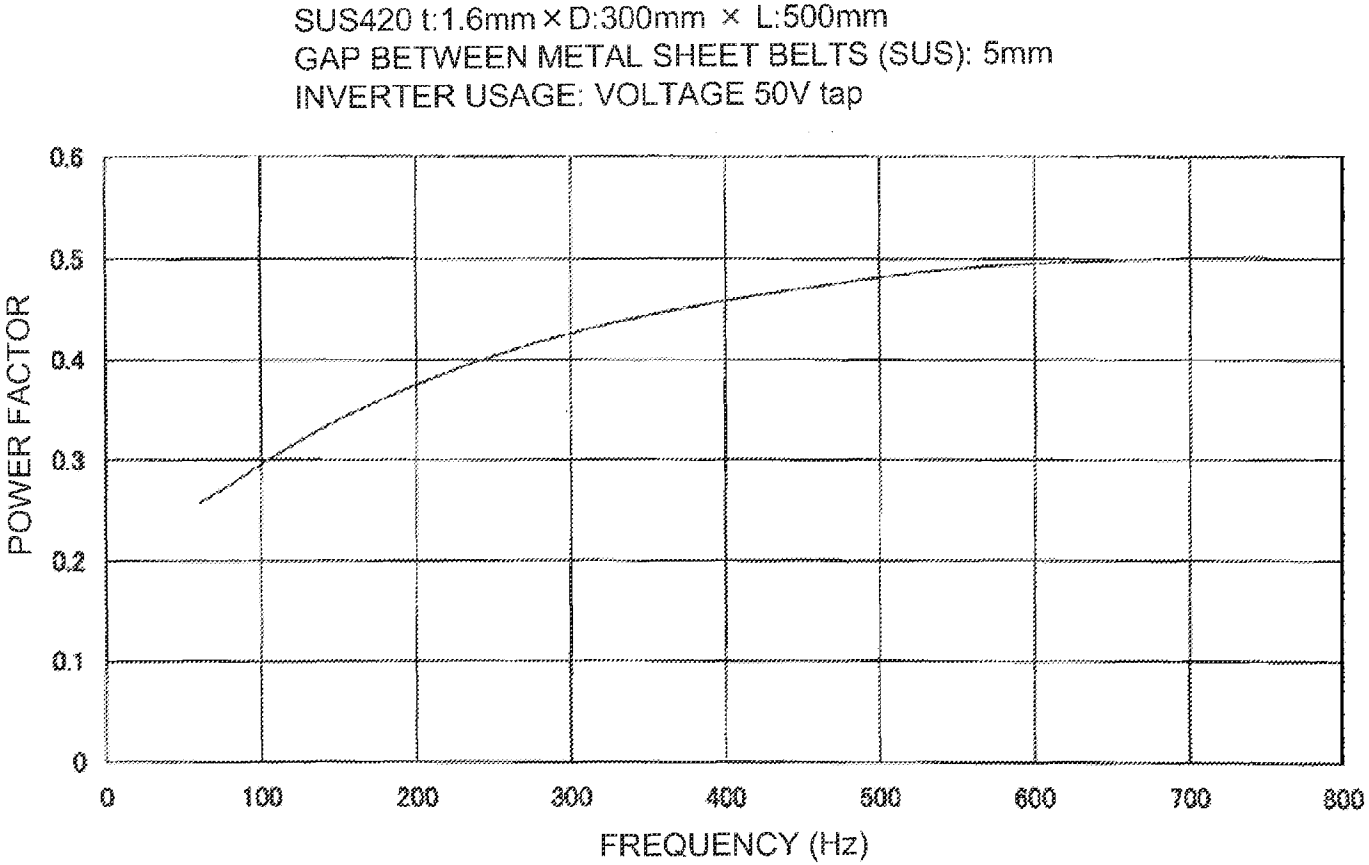
FIG.4 (PRIOR ART)
FIG. 4 is a graph diagram showing a characteristic of a relationship between a power factor and a frequency in the case of induction-heating SUS420 of 1.6 mm thick×300 mm wide using the conventional induction heating apparatus of the conventional hydraulic pressurizing type.

Herein, FIG. 4 shows a characteristic of a relationship between a power factor and a frequency in the case of induction-heating SUS420 of 1.6 mm thick×300 mm wide using an induction heating apparatus of a conventional hydraulic pressurizing type shown in FIG. 3. As can be seen from FIG. 4, it was found that the power factor is almost the same at a frequency of 500 Hz or higher and that an intermediate frequency is suited in the induction heating of a metal sheet (in particular, SUS420).

Figure 5:
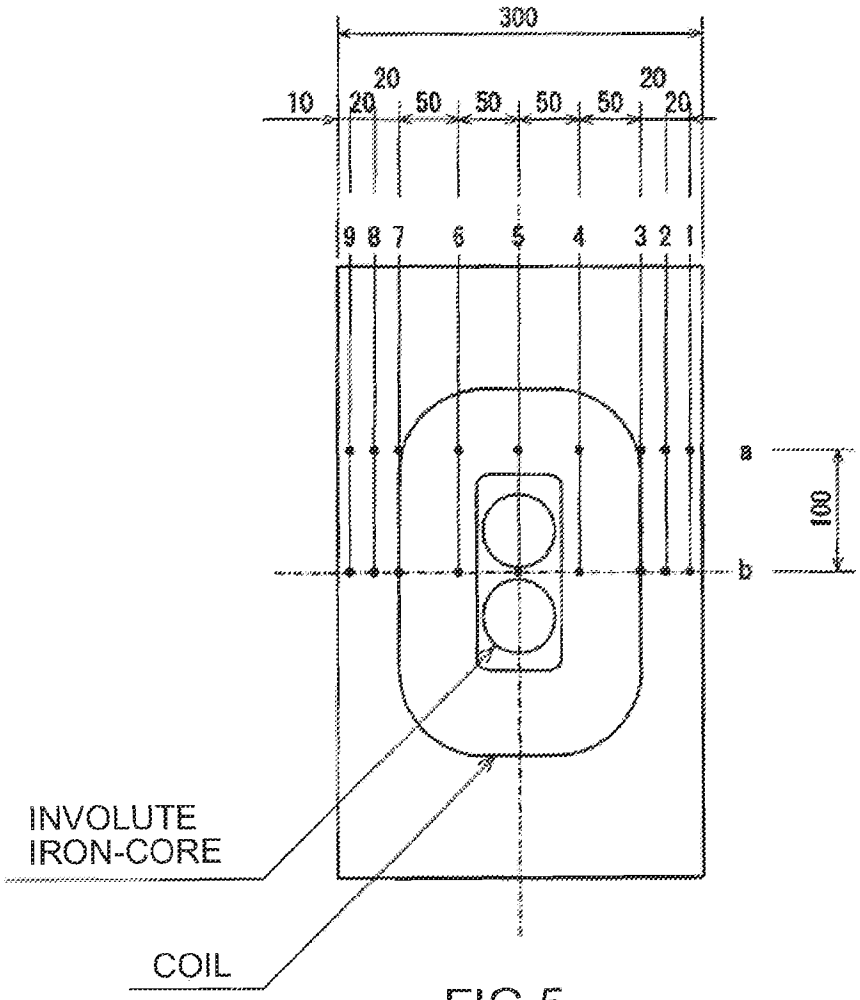
FIG. 5 is a diagram showing a position of a temperature sensor in the case of induction-heating SUS420 of 1.6 mm thick×300 mm wide using the induction heating apparatus of the second embodiment.

Next, experimental results are shown in the case of induction-heating SUS420 of 1.6 mm thick×300 mm wide using the induction heating apparatus of the second embodiment. Note that, in this experiment, there are used two involute iron-cores, each of which is formed in a cylindrical shape by laminating multiple layers of magnetic steel plate having a curved portion that is curved in a shape of an involute curve, as the center iron core of the flat-shaped coil. In addition, installation positions of a temperature sensor are a1 to a9 and b1 to b9 as shown in FIG. 5.

Figure 6:
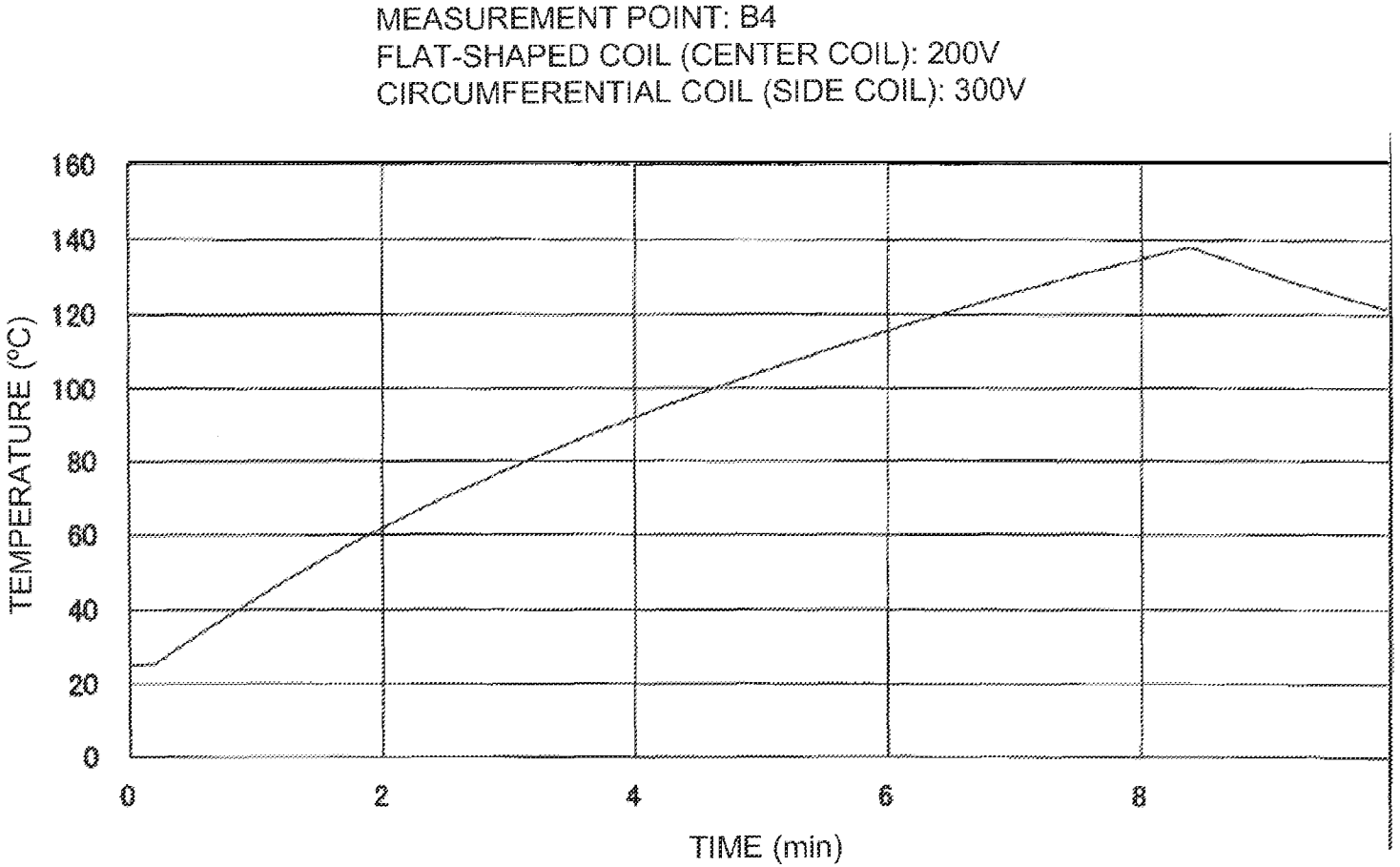
FIG. 6 is a graph diagram showing a temperature rising characteristic in a position b4 when induction-heating SUS420 of 1.6 mm thick×300 mm wide using the induction heating apparatus of the second embodiment.

First, FIG. 6 shows a temperature rising characteristic at a position b4 of installing the temperature sensor b4 using the induction heating apparatus of the second embodiment. At this time, AC voltage of 200V (at a frequency of 540 Hz) was applied to the flat-shaped coil and AC voltage of 300V (at a frequency of 540 Hz) was applied to the circumferential coil.

Figure 7:
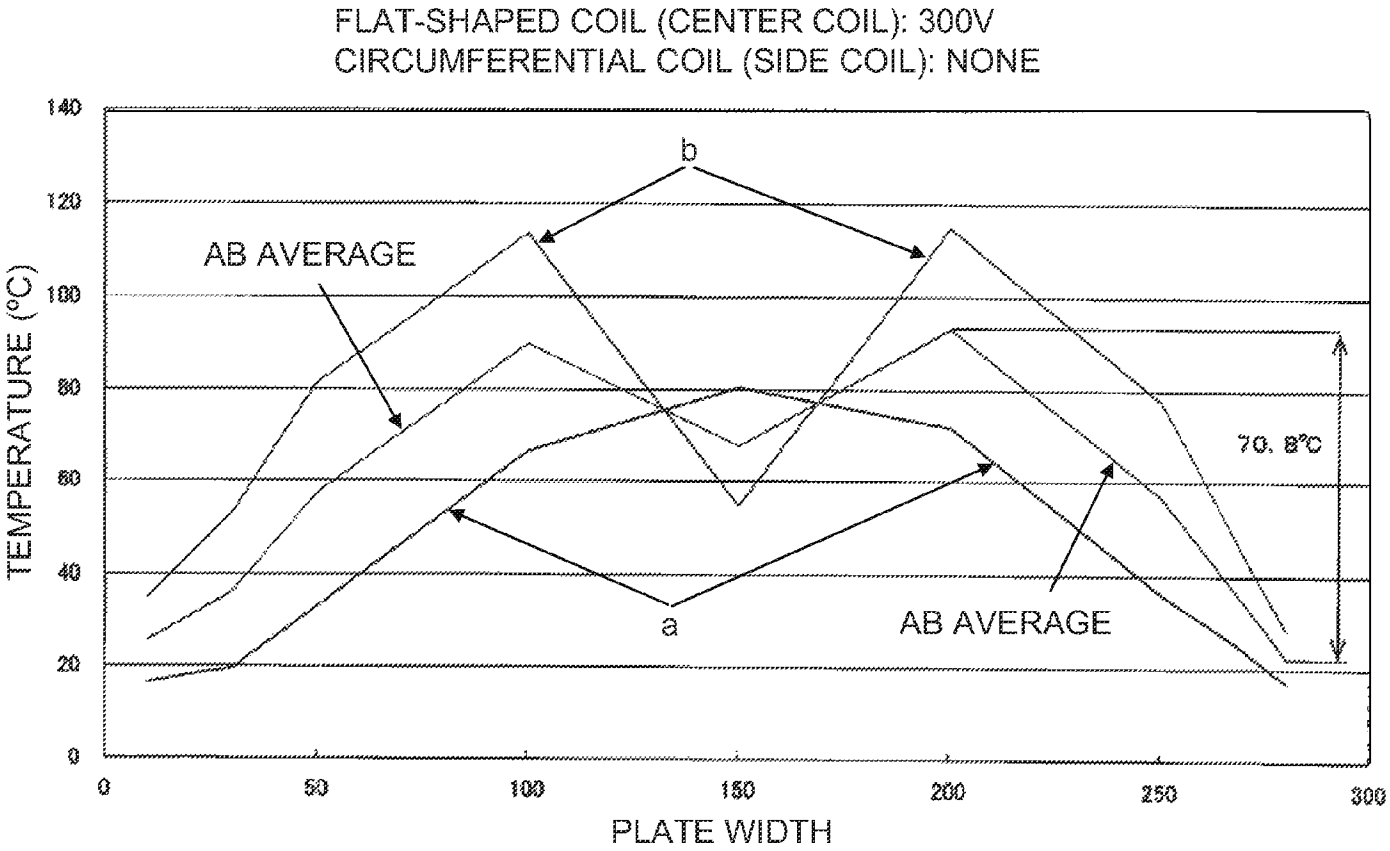
FIG. 7 is a graph diagram showing a temperature analysis and an average temperature distribution at positions a and b in the case of electrifying only a flat-shaped coil in the induction heating apparatus of the second embodiment.

Next, FIG. 7 shows a temperature analysis at the positions a and b and an average temperature distribution at the positions a and b in the case of electrifying only the flat-shaped coil in the induction heating apparatus of the second embodiment. Herein, AC voltage of 200V (at a frequency of 540 Hz) was applied to the flat-shaped coil. At this time, a temperature difference between the highest temperature and the lowest temperature in the average temperature distribution in the widthwise direction of the metal sheet belts was 70.8° C.

Figure 8:
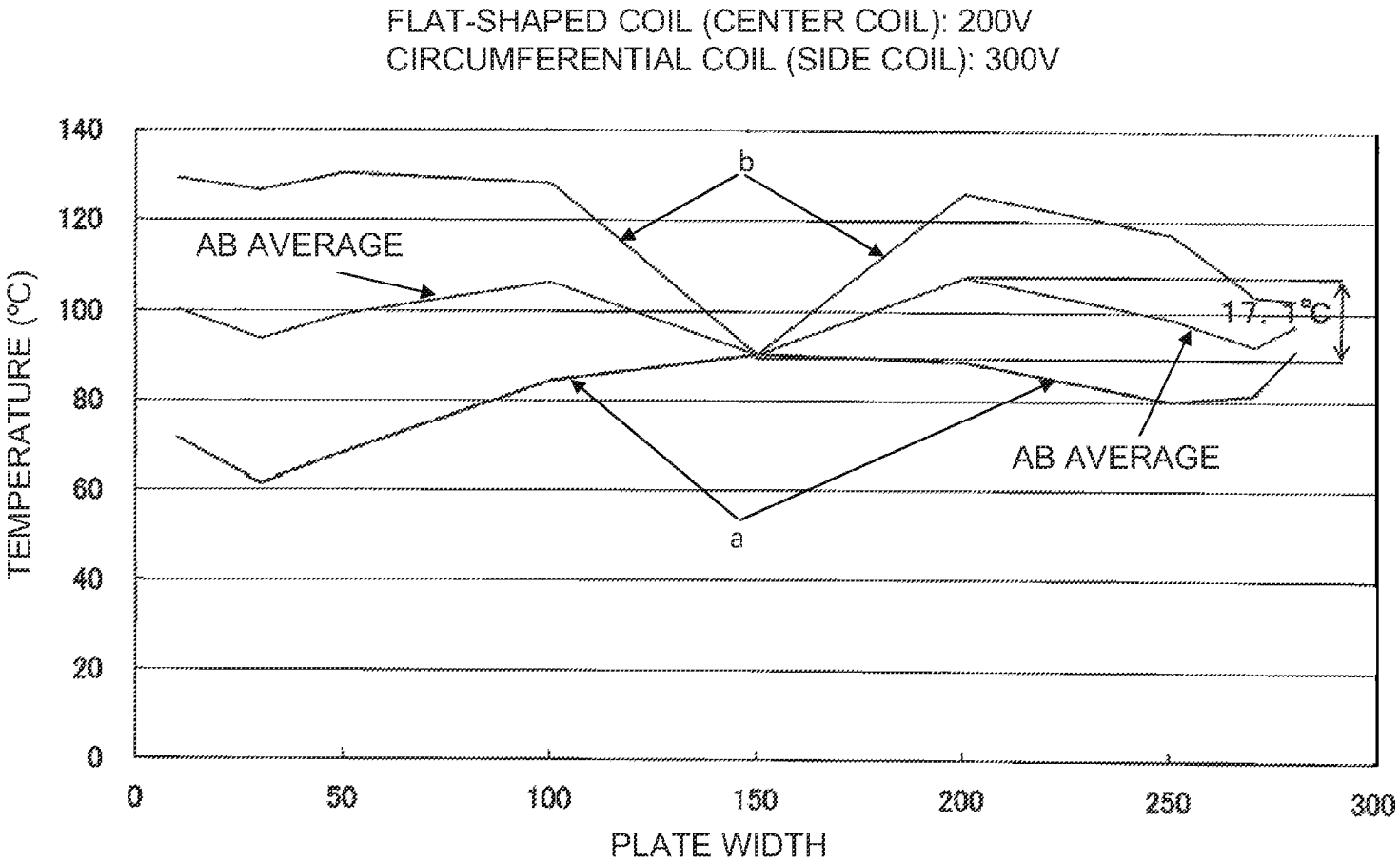
FIG. 8 is a graph diagram showing a temperature analysis and an average temperature distribution at positions a and b in the case of electrifying both a flat-shaped coil and a circumferential coil in the induction heating apparatus of the second embodiment.

On the other hand, FIG. 8 shows a temperature analysis at the positions a and b and an average temperature distribution at the positions a and b in the case of electrifying both of the flat-shaped coil and the circumferential coil in the induction heating apparatus of the second embodiment. Herein, AC voltage of 200V (at a frequency of 540 Hz) was applied to the flat-shaped coil and AC voltage of 300V (at a frequency of 540 Hz) was applied to the circumferential coil. At this time, a temperature difference between the highest temperature and the lowest temperature in the average temperature distribution in the widthwise direction of the metal sheet belts was 17.1° C. In this way, it was found that, by electrifying not only the flat-shaped coil but also the circumferential coil, the temperatures in the temperature distribution in the widthwise direction of the metal sheet belts can be made uniform.

In addition, in the induction heating apparatus 100 of the second embodiment, by adjusting the electrification amounts of the flat-shaped coils 3 and 4 and the electrification amounts of the circumferential coils 9 and 10, it becomes possible to control the temperature distribution in the widthwise direction of the metal sheet belts B.

Third Embodiment

Similarly to the second embodiment, the induction heating apparatus 100 according to a third embodiment is adapted to pressurize an insulating substance W, which is a heating target object, with a pair of upper and lower metal sheet belts B and induction-heat the metal sheet belts B at an intermediate frequency of 50 Hz to 1000 Hz to thereby heat the heating target object W. Note that, in FIGS. 9 and 10, component members corresponding to those in the first and second embodiments are denoted by the same reference numerals.

Figure 9:
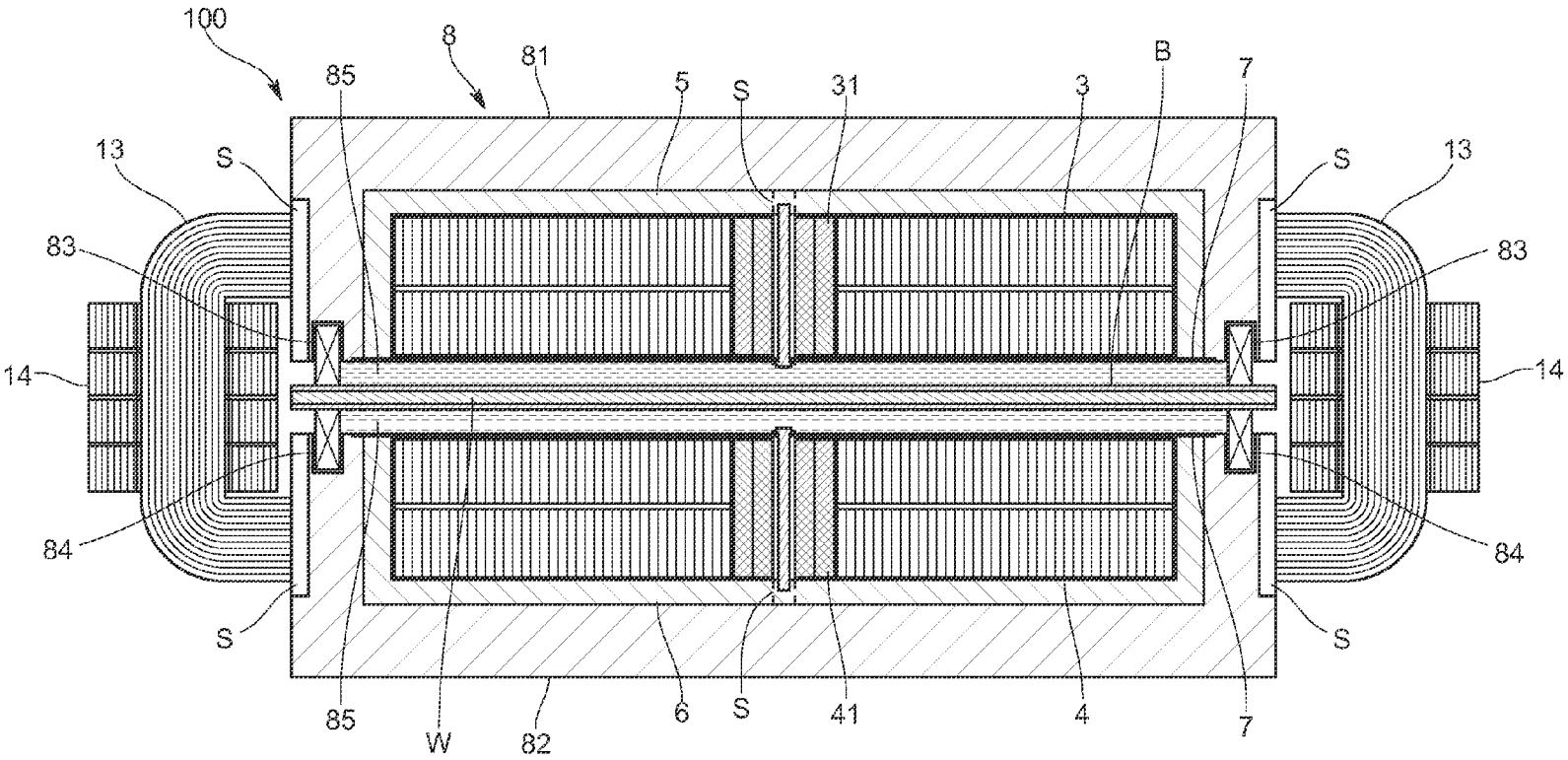
FIG. 9 is a sectional view showing a section orthogonal to a conveying direction of an induction heating apparatus according to a third embodiment.
Figure 10:
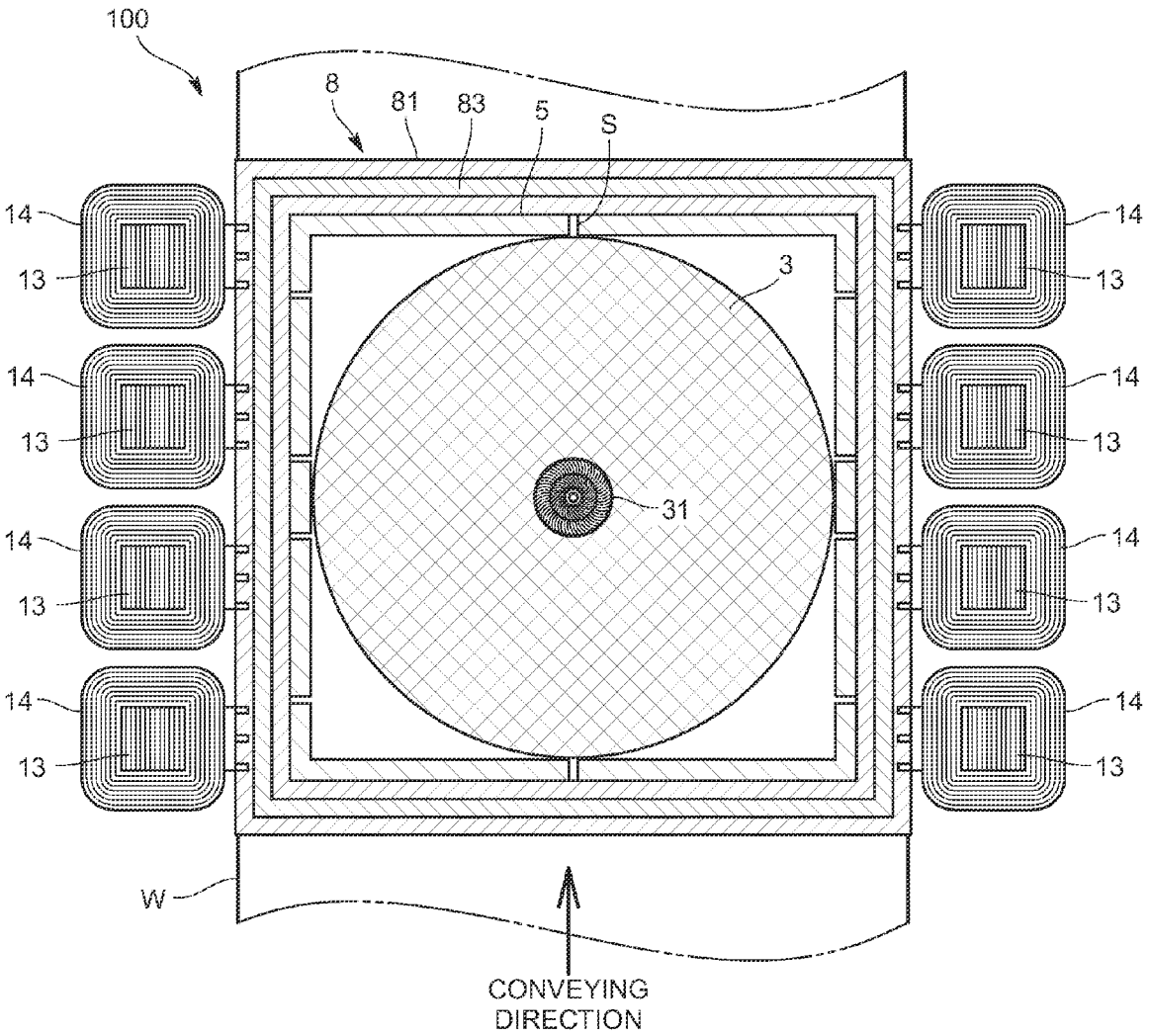
FIG. 10 is a sectional view showing a section along the conveying direction of the induction heating apparatus according to the third embodiment.

Meanwhile, as shown in FIGS. 9 and 10, the induction heating apparatus 100 of the third embodiment has a configuration different from that of the second embodiment having the circumferential coils 9 and 10 and the cover members 11 and 12. That is, the induction heating apparatus 100 of the third embodiment includes iron-core members 13 respectively provided in contact with right and left outer surfaces of the first and second hydraulic casings 81 and 82 and circumferential coils 14 wounded around the iron-core members 13.

Each of the iron-core members 13 is a cut core type wound iron-core with one cut surface thereof provided in surface-contact with the side surface of the first hydraulic casing 81 and the other cut surface thereof provided in surface-contact with the side surface of the second hydraulic casing 82. In addition, as shown in FIG. 10, a plurality of the iron-core members 13 and the circumferential coils 14 are provided respectively on the right and left sides (respectively, four on the right and left sides in FIG. 10) along the conveying direction of the heating target object W.

By this iron-core member 13, there is formed a magnetic path in which a magnetic flux generated by the circumferential coil 14 passes through the right and left end portions of the metal sheet belts B via the side walls of the first and second hydraulic casings 81 and 82. Thus, the right and left end portions of the metal sheet belts B can be surely heated.

In addition, in order to suppress heat generation of the first and second hydraulic casings 81 and 82 so as to increase a heat generation ratio of the right and left end portions of the metal sheet belts B, there are formed slits S of appropriate depths in the contact surfaces in the first and second hydraulic casings 81 and 82 in contact with the iron-core members so as to reduce the short-circuit current.

In addition, similarly to the second embodiment, by adjusting the electrification amounts of the flat-shaped coils 3 and 4 and the electrification amounts of the circumferential coils 14, it becomes possible to control the temperature distribution in the widthwise direction of the meta sheet belts B.

It should be noted that the present invention is not limited to each of the embodiments described above.

For example, in the second embodiment, although the induction heating apparatus is provided with the circumferential coils 9 and 10 and cover members 11 and 12 assuming that the induction heating apparatus is hydraulic pressurizing type one, the circumferential coils 9 and 10 and cover members 11 and 12 may be provided in the first embodiment. In this case, since the induction heating apparatus 100 does not includes the hydraulic pressurizing casings 81 and 82, the circumferential coils 9 and 10 are provided around the first and second circumferential magnetic path members 5 and 6, and the first and second cover members 11 and 12 are provided on the circumferential magnetic path members 5 and 6, respectively.

Also, in the third embodiment, although the induction heating apparatus is provided with the iron-core members 13 and circumferential coils 14 assuming that the induction heating apparatus is a hydraulic pressurizing type one, the iron-core members 13 and circumferential coils 14 may be provided in the first embodiment. In this case, since the induction heating apparatus 100 does not include the hydraulic pressurizing casings 81 and 82, the iron-core members 13 are provided on the side surfaces of the circumferential magnetic path members 5 and 6, respectively.

Figure 11:
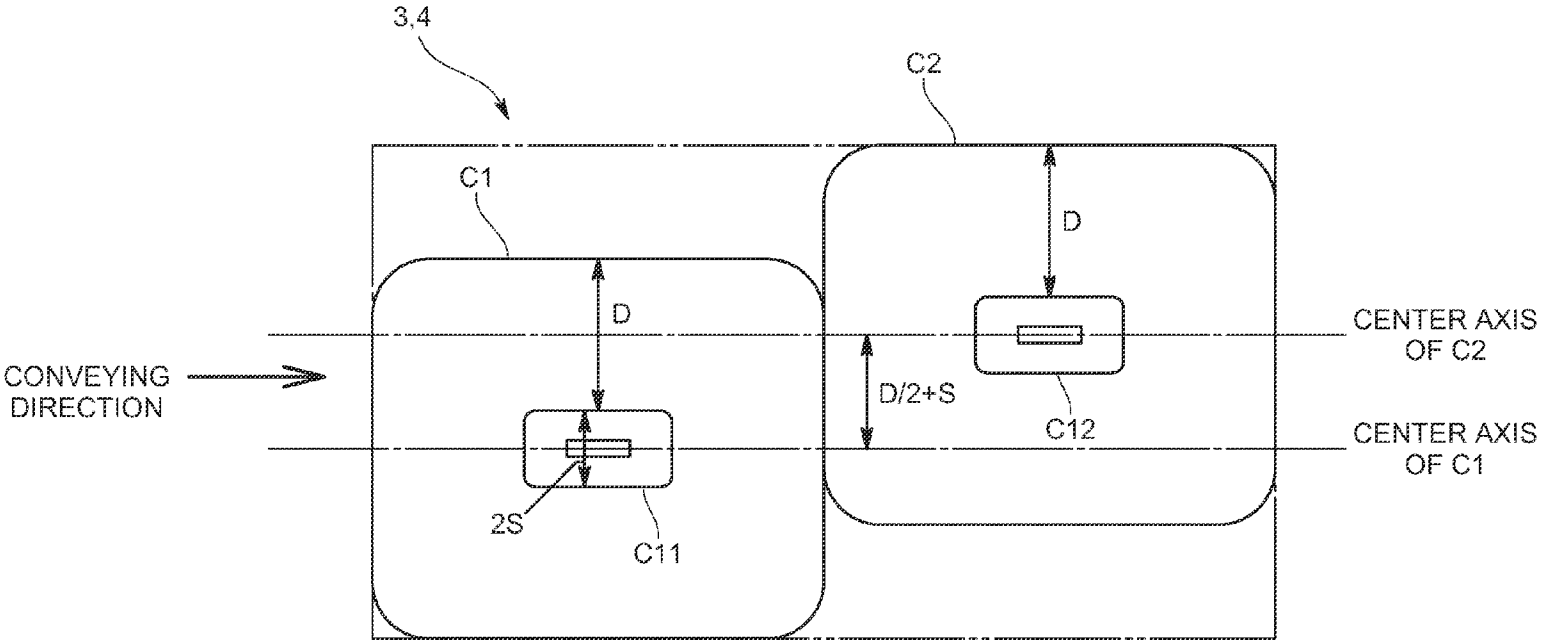
FIG. 11 is a plan view showing a flat-shaped coil of an induction heating apparatus according to a modified embodiment.

Moreover, as shown in FIG. 11, the first flat-shaped coil 3 and second flat-shaped coil 4 may be divided into a plurality of flat-shaped division coils that are arranged so as to be laterally shifted. FIG. 11 shows a case where the flat-shaped coils 3 and 4 are respectively divided into two flat-shaped division coils C1 and C2 having an identical configuration and identical shape to each other. Similarly to the flat-shaped coils 3 and 4, these two flat-shaped division coils C1 and C2 are schematically rectangular-shaped in a plan view, and are provided with center iron-cores C11 and C12 for forming coil center magnetic paths in the center portions of the coils C1 and C2, respectively. Herein, the two flat-shaped division coils C1 and C2 are arranged in a manner that the center axes thereof are arranged in the same direction and the center axis of one of the two flat-shaped division coils (C1) is set to a position where a winding diameter of a wound coil of the other flat-shaped division coil C2 is divided into two. In other words, assuming that width sizes of the center iron cores C11 and C12 of the flat-shaped division coils C1 and C2 are 2S and winding diameters of the wound coils of the flat-shaped division coils C1 and C2 are D, the flat-shaped division coils C1 and C2 are arranged in a manner that a shifted distance in width between the two center axes is D/2+S. By this arrangement, the lateral temperature distribution of the metal sheet can be made more uniform.

Figure 12:
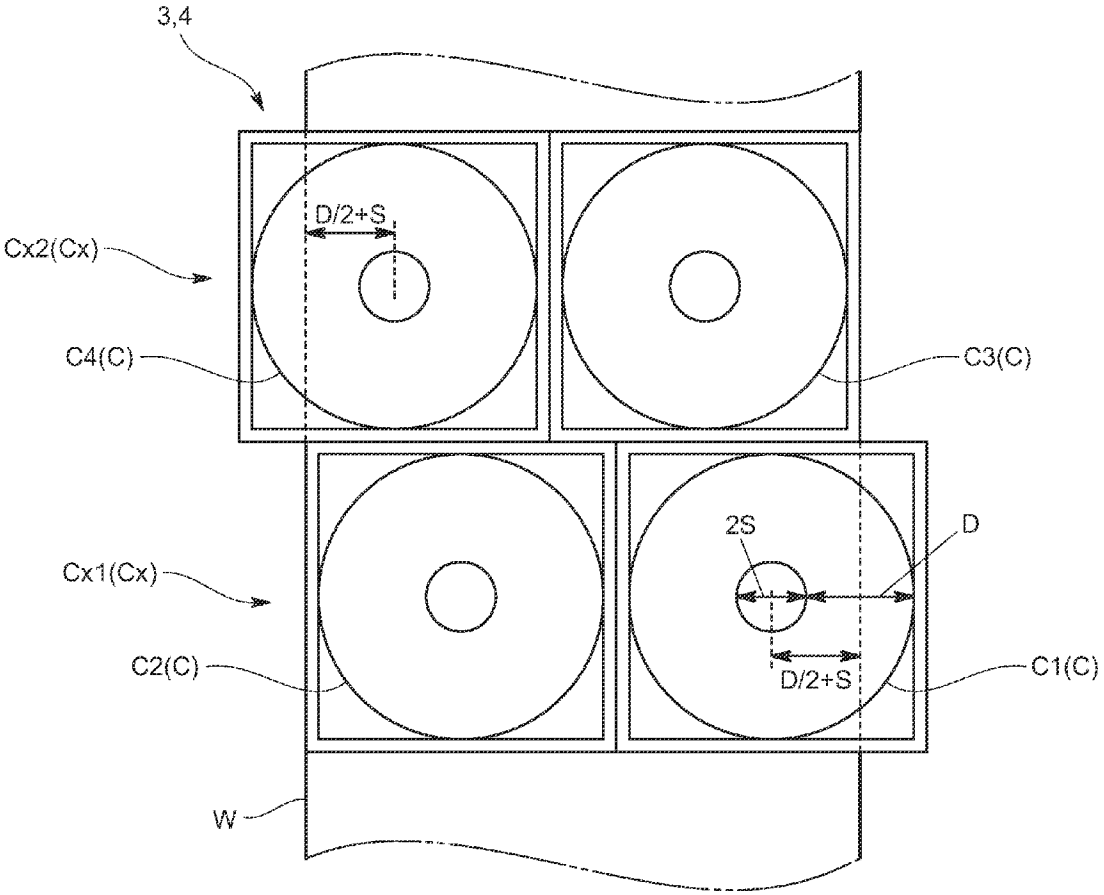
FIG. 12 is a plan view showing a flat-shaped coil of an induction heating apparatus according to a modified embodiment.

Moreover, as shown in FIG. 12, the first flat-shaped coil 3 and second flat-shaped coil 4 may be divided into a plurality of flat-shaped division coils C, and coil units Cx each of which is composed of at least one flat-shaped division coil C arranged in a widthwise direction orthogonal to a conveyance direction are arranged in multiple stages along the conveyance direction, and, in the at least one of the coil units Cx, the flat-shaped division coil C composing the corresponding one coil unit Cx may be arranged so as to extend off the conductive plate member W such as a metal sheet etc. outwardly in the widthwise direction. In specific, the flat-shaped division coils C composing adjacent two coil units Cx are arranged so as to be laterally shifted.

In FIG. 12, the first flat-shaped coil 3 and second flat-shaped coil 4 are divided into four flat-shaped division coils C1 to C4 each having the same shape, and coil units Cx1 and Cx2 composed by arranging respectively two flat-shaped division coils C1, C2 and C3, C4 in the widthwise direction orthogonal to the conveyance direction are arranged in two stages along the conveyance direction. And the right-hand flat-shaped division coil C1 composing the coil unit Cx1 located in an upstream side of the conveyance is arranged with its right side portion extending rightward off the right end portion of the conductive plate member W. Also, the left-hand flat-shaped division coil C4 composing the coil unit Cx2 located in a downstream side of the conveyance is arranged with its left side portion extending leftward off the left end portion of the conductive plate member W.

Herein, assuming that width sizes of the center iron cores of the flat-shaped division coils C1 to C4 are 2S and winding diameters of the wound coils of the flat-shaped division coils C1 and C2 are D, a heating value becomes the most at a position where a distance from the center in the flat-shaped division coils C1 to C4 is "D/2+S".

Therefore, it is configured such that, in the at least one coil unit Cx in the middle of the conveyance, one end portion or the other end portion in the widthwise direction of the conductive plate member W passes through the position of "D/2+S" of the flat-shaped division coil C composing the corresponding coil unit Cx. With this arrangement, one end portion or the other end portion in the widthwise direction of the conductive plate member W can be efficiently heated. In FIG. 12, the right end portion of the conductive plate member W passes through the position of "D/2+S" of the flat-shaped division coil C1 and the left end portion of the conductive plate member W passes through the position of "D/2+S" of the flat-shaped division coil C4. In other words, the coil unit Cx1 in the upstream side of the conveyance and coil unit Cx2 in the downstream side of the conveyance are arranged in a manner that a shifted distance in width between the coil unit Cx1 and the coil unit Cx2 is D/2+S.

In addition, the extending amount of the flat-shaped division coil C (C1 in FIG. 12) in the right end portion of the conductive plate member W is made equal to the extending amount of the flat-shaped division coil C (C4 in FIG. 12) in the left end portion of the conductive plate member W. With this arrangement, a temperature at the right end portion of the conductive plate member W and a temperature at the left end portion of the conductive plate member W can be made substantially equal.

By arranging the flat-shaped division coils C1 to C4 in this manner, both end portions in the widthwise direction of the conductive plate member W can be heated as well as the center portion of the conductive plate member W so that the temperature distribution in the widthwise direction of the conductive plate member W can be made uniform.

Figure 13:
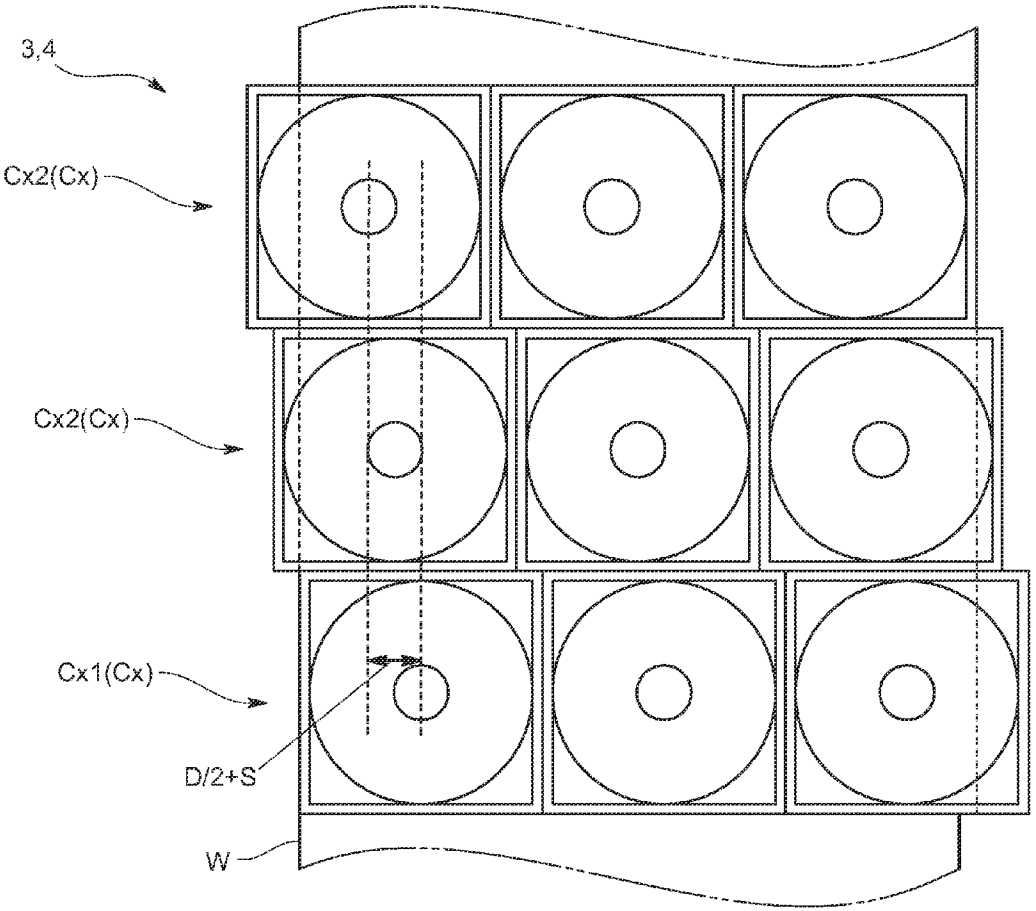
FIG. 13 is a plan view showing a flat-shaped coil of an induction heating apparatus according to a modified embodiment.

In addition to the configuration shown in FIG. 12, the coil units Cx may be arranged in three or more stages along the conveyance direction, and each of the coil units Cx may be composed of one flat-shaped division coil C or three or more flat-shaped division coils C. At this time, a shifted amount between the flat-shaped division coils C of the adjacent coil units Cx is adjusted so that the temperature distribution in the widthwise direction of the conductive plate member W is made uniform. In FIG. 13, there is shown a case where the coil units Cx composed of three flat-shaped coils C are arranged in three stages. In FIG. 13, the coil unit Cx1 in the upmost-stream side of the conveyance and coil unit Cx3 in the downmost-stream side of the conveyance are arranged in a manner that a shifted distance in width between the coil unit Cx1 and the coil unit Cx3 is D/2+S and the coil units Cx2 in the middle-stream of the conveyance are arranged in a manner that a shifted distance in width between intermediate portions thereof is (D/4+S/2).

In addition, in the case where each of the coil units Cx is composed of two or more flat-shaped division coils C, the magnetic flux is adjusted by controlling electric current flowing through each of the flat-shaped division coils C so that the temperature distribution in the widthwise direction of the conductive plate member W can be also controlled.

Moreover, it is not necessary for the flat-shaped division coils C composing the coil units Cx to have the same shape, and the flat-shaped division coils having different sizes may be combined in order to make the temperature distribution uniform in the widthwise direction.

Furthermore, in the embodiments described above, although the induction heating apparatus is a conveyance processing type one for conveying a conductive plate member to be processed, the present invention may be adapted to an induction heating apparatus of a batch processing type for induction-heating every conductive plate member.

Figure 14:
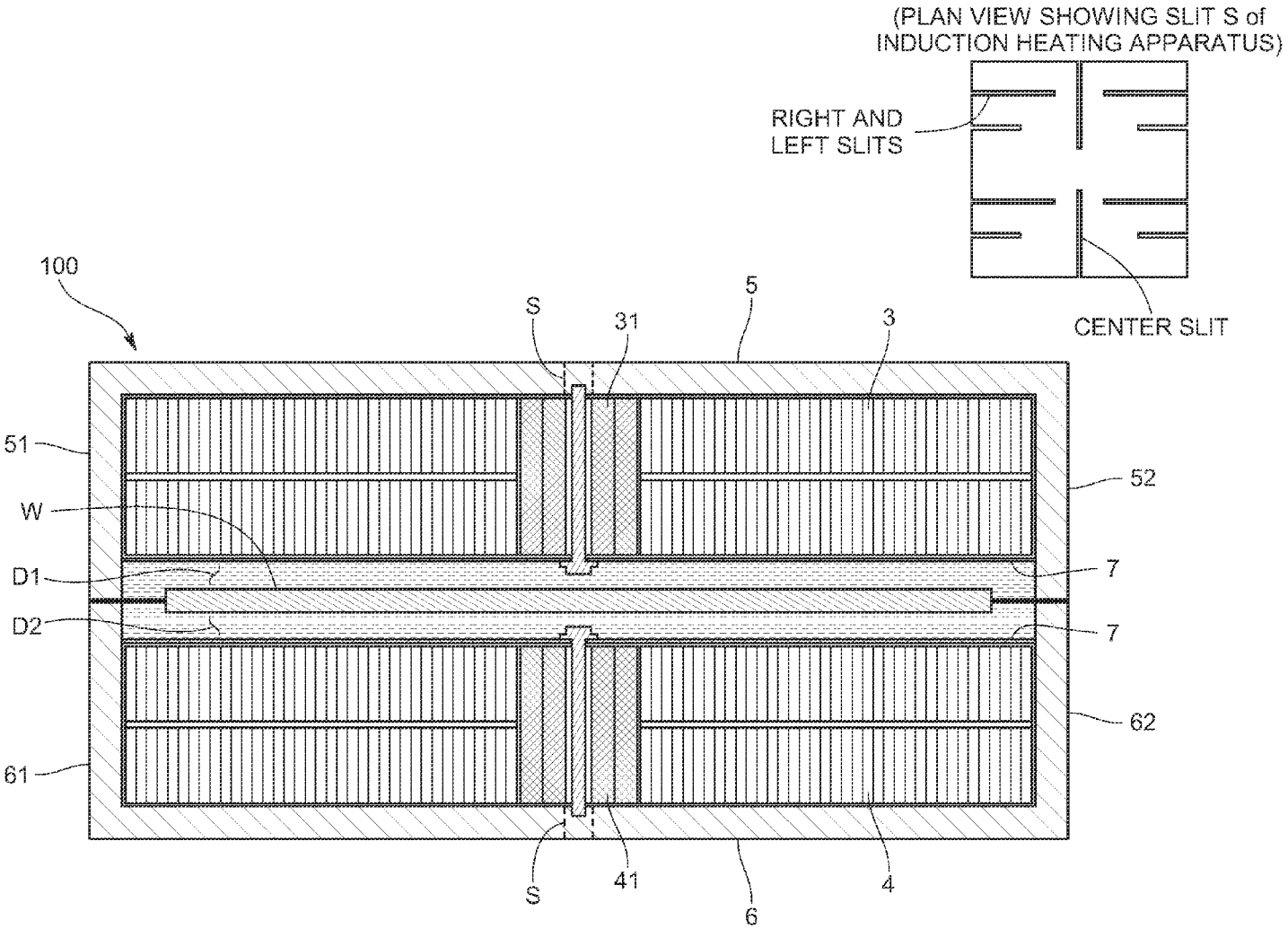
FIG. 14 is a longitudinal section view of an induction heating apparatus of a batch-processing type according to a modified embodiment.

In this case, as shown in FIG. 14, the induction heating apparatus includes: the first flat-shaped coil 3 arranged on the upper side of the conductive plate member W and provided with a magnetic path orthogonal to the conductive plate member in the center portion thereof; the second flat-shaped coil 4 arranged on the lower side of the conductive plate member W and provided with a magnetic path orthogonal to the conductive plate member W in the center portion thereof; the first circumferential magnetic path member 5 arranged around the first flat-shaped coil 3 and forming the circumferential magnetic path for guiding a magnetic flux generated by the first flat-shaped coil 3 to the outside of the conductive plate member W; and the second circumferential magnetic path member 6 arranged around the second flat-shaped coil 4 and forming the circumferential magnetic path for guiding the magnetic flux generated by the second flat-shaped coil 4 to the outside of the conductive plate member W and connected to the first circumferential magnetic path member 5. By providing the first and second circumferential magnetic path members 5 and 6, it is configured that the magnetic fluxes generated by the first and second flat-shaped coils 3 and 4 pass through the end portions of the conductive plate member W in the surface direction thereof. In addition, in FIG. 14, since the first and second circumferential magnetic path members 5 and 6 have rectangular parallelepiped shapes, in the case of induction-heating the conductive plate member W having a rectangular shape in plan view, the four side end portions (peripheral end portions) thereof can be heated as well as the central portion of the conductive plate member so that the temperature distribution in the surface direction of the conductive member can be made uniform.

Herein, a first heat insulating member D1 for insulating heat from the conductive plate member W is provided between the first flat-shaped coil 3 and the conductive plate member W. Also, a second heat insulating member D2 for insulating heat from the conductive plate member W is provided between the second flat-shaped coil 4 and the conductive plate member W. The first insulating member D1 is provided to be filled in a whole space surrounded by an insulating plate 7 provided on the lower surface of the first flat-shaped coil 3 and four side walls (front and rear side walls and right and left side walls). Also, the second insulating member D2 is provided to be filled in a whole space surrounded by an insulating plate 7 provided on the upper surface of the second flat-shaped coil 4 and four side walls (front and rear side walls and right and left side walls). Thus, the conductive plate member W is held by the first and second heat insulating members D1 and D2 from the upper and lower sides thereof. In specific, the first and second heat insulating members D1 and D2 hold the conductive plate member W by covering the entire circumference thereof. With this configuration, it becomes unnecessary to provide a holding mechanism for holding a further conductive plate member W in addition to the insulating members D1 and D2 so that the configuration of the apparatus can be simplified. In addition, since the first and second heat insulating members D1 and D2 hold the conductive plate member W by covering the entire surface thereof, the heat insulation and holding of the conductive plate member W can be surely performed.

Figure 15:
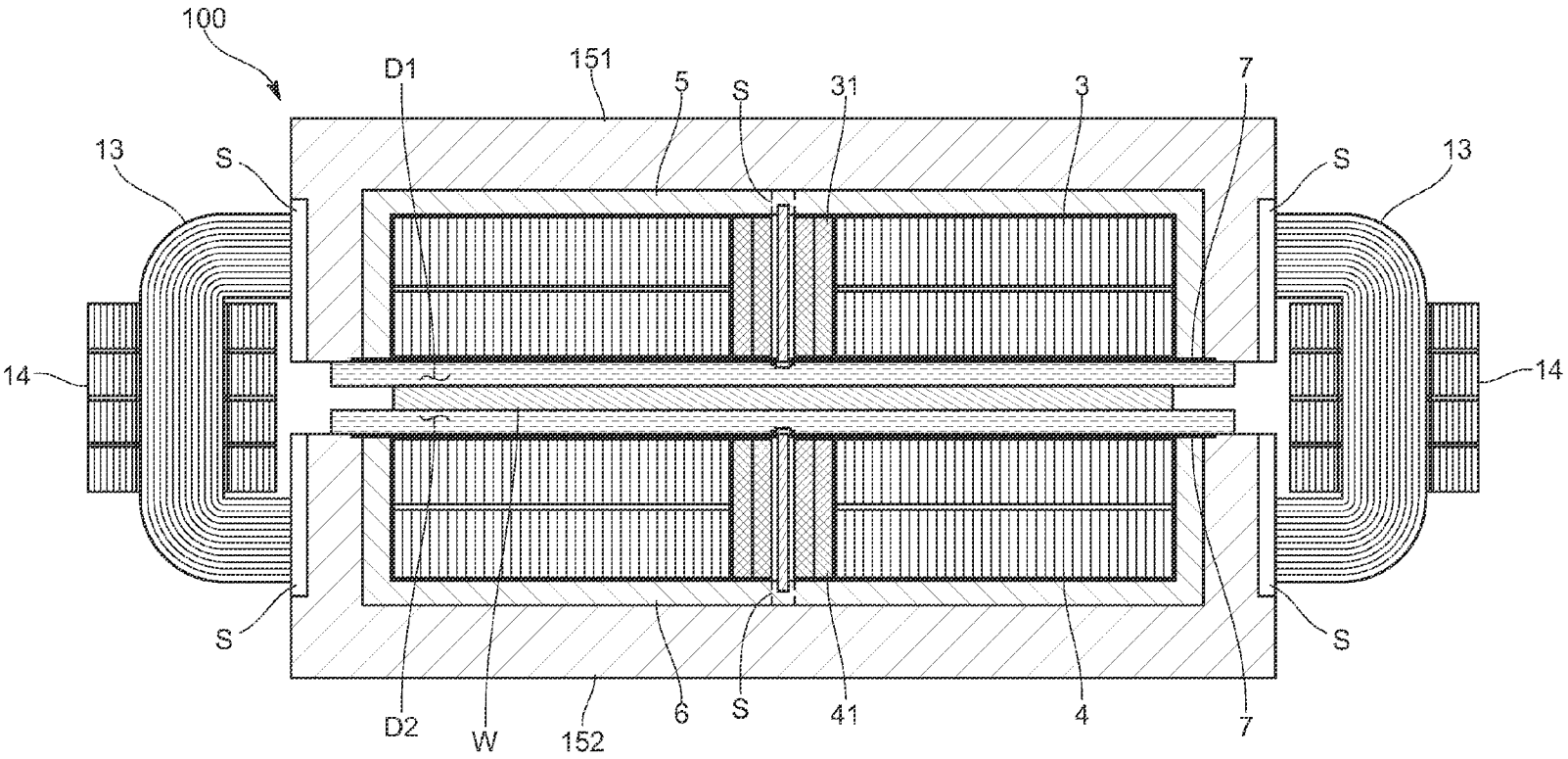
FIG. 15 is a longitudinal section view of an induction heating apparatus of a batch-processing type according to a modified embodiment.
Figure 16:
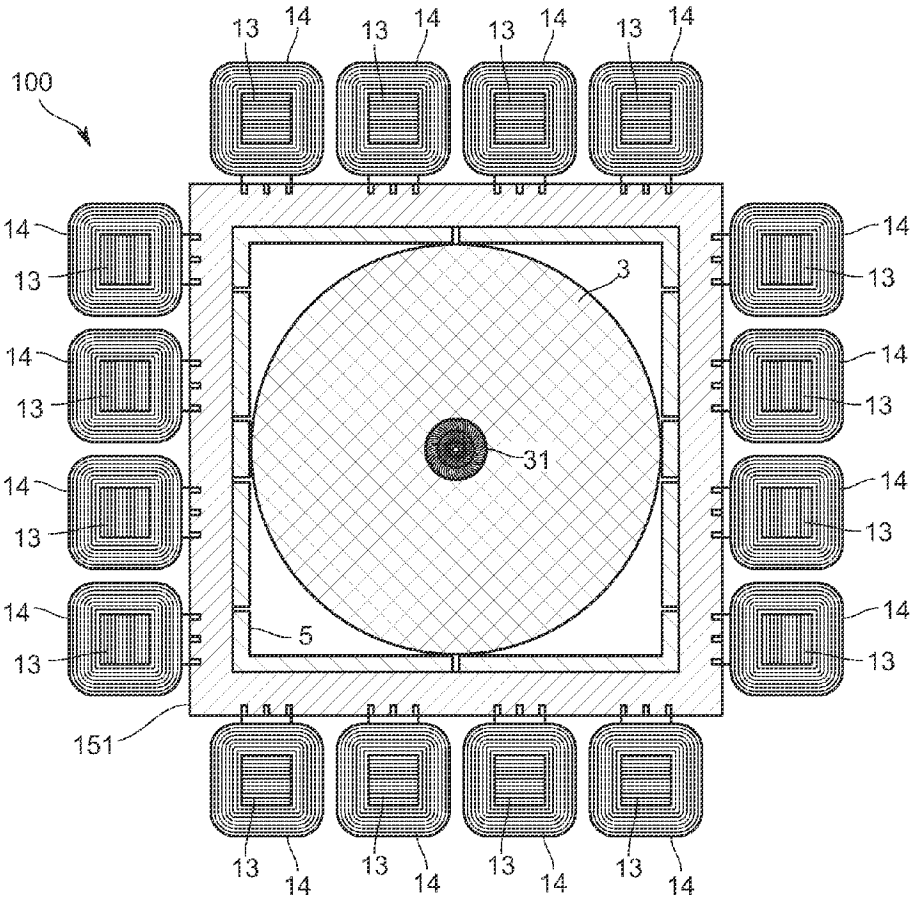
FIG. 16 is a lateral section view of an induction heating apparatus of a batch-processing type according to a modified embodiment.

Moreover, as shown in FIGS. 15 and 16, the conveyance processing type induction heating apparatus of the third embodiment may be modified as a batch processing type one. In this case, it is configured that multiple iron-core members 13 and multiple circumferential coils 14 are provided on four side surfaces (front and rear side surfaces and right and left side surfaces) of a first casing 151 provided around the first circumferential magnetic path member 5 and a second casing 152 provided around the second circumferential magnetic path member 6, respectively. Even in this case, the conductive plate member W is held by the first and second heat insulating members D1 and D2. Herein, the iron-core members 13 may be provided in contact with the side surfaces of the first and second circumferential magnetic path members 5 and 6, respectively, without providing the first and second casings 151 and 152.

In addition, it goes without saying that the present invention is not limited to the embodiments described above and various modifications may be made in the scope without departing from the spirit thereof.

REFERENCE CHARACTERS LIST

100 . . . Induction heating apparatus
W . . . Conductive plate member (metal sheet)
2 . . . Conveyance passage
3 . . . First flat-shaped coil
4 . . . Second flat-shaped coil

5 . . . First circumferential magnetic path member (first magnetic metal casing)
6 . . . Second circumferential magnetic path member (second magnetic metal casing)
7 . . . Insulating plate
8 . . . Pressurizing structure
9 . . . First circumferential coil
10 . . . Second circumferential coil
11 . . . First cover member
12 . . . Second cover member
13 . . . Iron-core member
14 . . . Circumferential coil
C1 . . . Flat-shaped division coil
C2 . . . Flat-shaped division coil

The invention claimed is:

1. An induction heating apparatus adapted to induction heating of a conductive plate member with an intermediate-frequency wave of 50 Hz to 1000 Hz, comprising:

a conveyance passage in which the conductive plate member is conveyed;

a first flat-shaped coil arranged on an upper side of the conveyance passage and provided with a magnetic path orthogonal to the conveyance passage in a center portion thereof;

a second flat-shaped coil arranged on a lower side of the conveyance passage and provided with a magnetic path orthogonal to the conveyance passage in a center portion thereof;

a first circumferential magnetic path member arranged around the first flat-shaped coil and forming a circumferential magnetic path for guiding a magnetic flux generated by the first flat-shaped coil to a lateral outside of the conveyance passage; and a second circumferential magnetic path member arranged around the second flat-shaped coil and forming a circumferential magnetic path for guiding a magnetic flux generated by the second flat-shaped coil to the lateral outside of the conveyance passage and connected to the first circumferential magnetic path member, wherein the magnetic fluxes generated by the first and second flat-shaped coils are configured to pass through both right and left end portions of the conductive plate member conveyed to the conveyance passage by the first and second circumferential magnetic path members; and the first flat-shaped coil and second flat-shaped coil are divided into a plurality of flat-shaped division coils that are arranged so as to be laterally shifted, wherein the first flat-shaped coil and second flat-shaped coil are divided into two flat-shaped division coils having the same configuration and the same shape that are arranged so that a center axis of one of the two flat-shaped division coils is set to a position where a winding diameter of a wound coil of the other flat-shaped division coil is divided into two.

2. The induction heating apparatus according to claim 1, comprising:

a first heat insulating member provided between the first flat-shaped coil and the conductive plate member so as to insulate heat from the conductive plate member; and a second heat insulating member provided between the second flat-shaped coil and the conductive plate member so as to insulate heat from the conductive plate member, wherein the first and second heat insulating members are configured to hold the conductive plate member from upper and lower sides thereof.

3. The induction heating apparatus according to claim 2, wherein the first and second heat insulating members are configured to hold the conductive plate member by covering the entire circumference thereof.

4. An induction heating apparatus adapted to induction heating of a conductive plate member with an intermediate-frequency wave of 50 Hz to 1000 Hz, comprising:

a conveyance passage in which the conductive plate member is conveyed;

a first flat-shaped coil arranged on an upper side of the conveyance passage and provided with a magnetic path orthogonal to the conveyance passage in a center portion thereof;

a second flat-shaped coil arranged on a lower side of the conveyance passage and provided with a magnetic path orthogonal to the conveyance passage in a center portion thereof;

a first circumferential magnetic path member arranged around the first flat-shaped coil and forming a circumferential magnetic path for guiding a magnetic flux generated by the first flat-shaped coil to a lateral outside of the conveyance passage; and a second circumferential magnetic path member arranged around the second flat-shaped coil and forming a circumferential magnetic path for guiding a magnetic flux generated by the second flat-shaped coil to the lateral outside of the conveyance passage and connected to the first circumferential magnetic path member, wherein the magnetic fluxes generated by the first and second flat-shaped coils are configured to pass through both right and left end portions of the conductive plate member conveyed to the conveyance passage by the first and second circumferential magnetic path members; and the first flat-shaped coil and second flat-shaped coil are divided into a plurality of flat-shaped division coils that are arranged so as to be laterally shifted, wherein the first flat-shaped coil and second flat-shaped coil are divided into a plurality of flat-shaped division coils and coil units, each of which is composed of at least one flat-shaped division coil arranged in a widthwise direction orthogonal to a conveyance direction are arranged in multiple stages along the conveyance direction, and wherein, in at least one of the coil units, said at least one flat-shaped division coil composing said corresponding one coil unit is arranged so as to extend off the conductive plate member outwardly in the widthwise direction, wherein, in the flat-shaped division coil extending off the conductive plate member outwardly in the widthwise direction, each end portion in the widthwise direction of the conductive plate member passes through a position where a winding diameter of a wound coil in the corresponding flat-shaped division coil is divided into two.

* * * * *